US010047714B2

(12) United States Patent
Kobayashi et al.

(10) Patent No.: US 10,047,714 B2
(45) Date of Patent: Aug. 14, 2018

(54) FUEL INJECTOR

(71) Applicant: HONDA MOTOR CO., LTD., Tokyo (JP)

(72) Inventors: Hiroki Kobayashi, Wako (JP); Kazuji Ono, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 15/729,995

(22) Filed: Oct. 11, 2017

(65) Prior Publication Data

US 2018/0142657 A1 May 24, 2018

(30) Foreign Application Priority Data

Nov. 18, 2016 (JP) ..... 2016-224668

(51) Int. Cl.
*F02M 61/18* (2006.01)

(52) U.S. Cl.
CPC ..... *F02M 61/188* (2013.01); *F02M 61/1806* (2013.01); *F02M 61/1813* (2013.01)

(58) Field of Classification Search
CPC ..... F02M 61/18; F02M 61/1806; F02M 61/1813; F02M 61/182; F02M 61/1826; F02M 61/1833; F02M 61/184; F02M 61/1846; F02M 61/188; F02M 63/0077
USPC ..... 239/533.12
See application file for complete search history.

(56) References Cited

U.S. PATENT DOCUMENTS 5,163,621 A * 11/1992 Kato ..... F02M 61/163 239/533.12
2004/0262430 A1* 12/2004 Joseph ..... F02M 51/0671 239/533.12
2006/0226264 A1* 10/2006 Bacho, III ..... F02M 61/168 239/533.12
2009/0272824 A1* 11/2009 Kitagawa ..... F02M 51/061 239/585.5
2010/0320293 A1* 12/2010 Ogura ..... F02M 51/0685 239/533.12
2015/0129687 A1* 5/2015 Kaneta ..... F02M 61/1806 239/585.5
2015/0377202 A1* 12/2015 Ishii ..... F02M 51/0671 239/584

FOREIGN PATENT DOCUMENTS

JP 2010248919 A 11/2010

* cited by examiner

*Primary Examiner* — Darren W Gorman
(74) *Attorney, Agent, or Firm* — Armstrong Teasdale LLP

(57) ABSTRACT

An injection hole of a fuel injector includes: an inner hole section extending from an inner surface of a bottom wall of an injector tip obliquely away from a first side relative to a normal line of the inner surface to define a first inner side wall surface on the first side forming an obtuse angle with the inner surface and a second inner side wall surface on a second side opposite to the first side forming an acute angle with the inner surface; a middle hole section including a first middle side wall surface extending obliquely from the first inner side wall surface toward the first side; and an outer hole section including a first outer side wall surface extending obliquely from the first middle side wall surface toward the first side. A recess is formed on a radially outer side of an inner end of the inner hole section.

10 Claims, 16 Drawing Sheets

FUEL INJECTOR

TECHNICAL FIELD

The present invention relates to a fuel injector for an internal combustion engine.

BACKGROUND ART

In a direct injection fuel injector of an internal combustion engine for an automobile, atomization of the injected fuel and reduction of penetration of the injected fuel are desired in order to suppress adhesion of fuel to the cylinder wall surface and the piston crown surface. JP2010-248919A discloses a method of promoting atomization of fuel. According to this method, a diffuser portion consisting of an increased diameter portion is formed in an injection hole such that an outlet end of the injection hole is greater in diameter than the inlet end thereof, and separation vortices of a fuel flow are created in the injection hole.

However, in view of further improving thermal efficiency and minimizing impacts on the environment, further atomization of fuel and further reduction in penetration are desired.

In view of such problems of the prior art, a primary object of the present invention is to provide a fuel injector that allows further atomization of fuel and further reduction in penetration.

To achieve such an object, the present invention provides a fuel injector, comprising: a nozzle (21) including a tubular nozzle main body (27) extending along a predetermined central nozzle axial line (X) and internally defining a fuel passage (26), and a nozzle tip portion (28) including a bottom wall (30) defining an annular valve seat (29) facing the fuel passage in a coaxial relationship to the central nozzle axial line, the nozzle tip portion being provided with a plurality of injection holes (35) passed through the bottom wall and surrounded by the annular valve seat; and a valve member (23) disposed in the fuel passage to be moveable along the central nozzle axial line and configured to be selectively seated on the valve seat; wherein at least one of the injection holes includes an inner hole section (71), a middle hole section (72) and an outer hole section (73) in that order from a side of the fuel passage, the inner hole section extending from an inner surface (60) of the bottom wall obliquely away from a first side relative to a normal line of the inner surface of the bottom wall so as to define a first inner side wall surface (81) on the first side forming an obtuse angle relative to the inner surface on the first side and a second inner side wall surface (82) on a second side opposite to the first side forming an acute angle relative to the inner surface on the second side, the middle hole section including a first middle side wall surface (83) connected to the first inner side wall surface so as to extend obliquely relative to the first inner side wall surface toward the first side, and the outer hole section including a first outer side wall surface (85) connected to the first middle side wall surface so as to extend obliquely relative to the first middle side wall surface toward the first side; wherein a recess (65; 89) is formed on a radially outer side of an inner end of the inner hole section with respect to the central nozzle axial line and/or a part of the valve member opposing the radially outer side of the inner end of the inner hole section with respect to the central nozzle axial line.

Thereby, the fuel ejected from the injection hole can be further atomized, and can be limited in penetration. As the valve member is lifted from the valve seat, part of the fuel flows from a radially outer direction into the inner hole section, and the recess increases the sectional area of this flow, causing a reduction in the velocity of the fuel flow in this region. In addition, the inner side wall surface on the second side forms an acute angle relative to the inner surface of the bottom wall. Therefore, the part of the fuel flow entering the inner hole section from the second side separates from the inner side wall surface on the second side immediately after entering the inner hole section, and resulting turbulence promotes the atomization of the fuel. Further, because the middle side wall surface on the first side inclines away from the second side, the fuel flow advancing into the middle hole section is prevented from colliding with the middle side wall surface on the first side. Similarly, because the outer side wall surface on the first side inclines away from the second side, the fuel flow advancing into the outer hole section is prevented from colliding with the outer side wall surface on the first side. Thereby, the cone of the fuel flow is prevented from being narrowed. Owing to these features, the atomization of the fuel is enhanced, and the penetration of the fuel flow is minimized.

In this invention, it is preferable that the middle hole section includes a second middle side wall surface (84) on the second side continuously extending from the second inner side wall surface in a same direction.

Thereby, the drilling work for the injection hole is simplified while ensuring a favorable separation of the fuel flow from the side wall surface on the second side.

In the above configuration, it is preferable that the outer hole section includes a second outer side wall surface (86) on the second side that extends obliquely from the second middle side wall surface toward the second side for a short distance from the second middle side wall surface, and thence extends in parallel with the second middle side wall surface.

This feature also facilitates the drilling work of the injection hole while ensuring a favorable separation of the fuel flow from the side wall surface on the second side and preventing the narrowing of the cone of the injected fuel.

Preferably, the outer hole section includes a second outer side wall surface on the second side extending substantially in parallel with the first outer side wall surface.

Thereby, the drilling work of the outer hole section can be simplified.

Also preferably, the outer hole section includes a second outer side wall surface on the second side extending substantially in parallel with the second inner side wall surface.

Thereby, the outer hole section can be drilled in a direction parallel to the inner hole section, and therefore, the drilling work of the outer hole section can be facilitated.

In this invention, preferably, the middle hole section has a larger cross sectional area than the inner hole section, and the outer hole section has a larger cross sectional area than the middle hole section.

Thereby, the separated fuel flow is prevented from colliding with the opposing side wall surface so that the narrowing of the cone of the injected fuel is prevented, atomization of fuel is promoted, and fuel penetration is minimized.

Preferably, the inner hole section consists of a linearly extending hole having a constant circular cross section.

Thereby, the drilling work for the inner hole section of the injection hole can be simplified.

Also preferably, the outer hole section has an outermost part consisting of a linearly extending hole having a constant circular cross section.

Thereby, the drilling work for the outer hole section of the injection hole can be simplified.

According to a preferred embodiment of the present invention, the injection holes are formed in the bottom wall of the nozzle tip portion along a concentric circle relative to the nozzle axial line, and the recess comprises an annular recess concentrically surrounding the injection holes.

Thereby, the recess can be formed in a simple and accurate manner.

Preferably, the bottom wall comprises a conical or dome-shaped wall defining a concave inner surface (31) and a convex outer surface (32), and the recess includes an annular bottom surface (66) orthogonal to the nozzle axial line and a cylindrical side surface (67) extending in parallel with the nozzle axial line.

Thereby, a uniform and favorable distribution of the fuel flow can be achieved so that a favorable atomization of fuel and a reduction in fuel penetration can be achieved in an inexpensive manner.

Thus, the present invention provides a fuel injector that allows further atomization of fuel and further reduction in penetration.

DETAILED DESCRIPTION OF THE PREFERRED EMBODIMENT(S)

First Embodiment

A direct injection fuel injector for an automotive internal combustion engine according to a first embodiment of the preset invention is described in the following with reference to the appended drawings.

Figure 1:
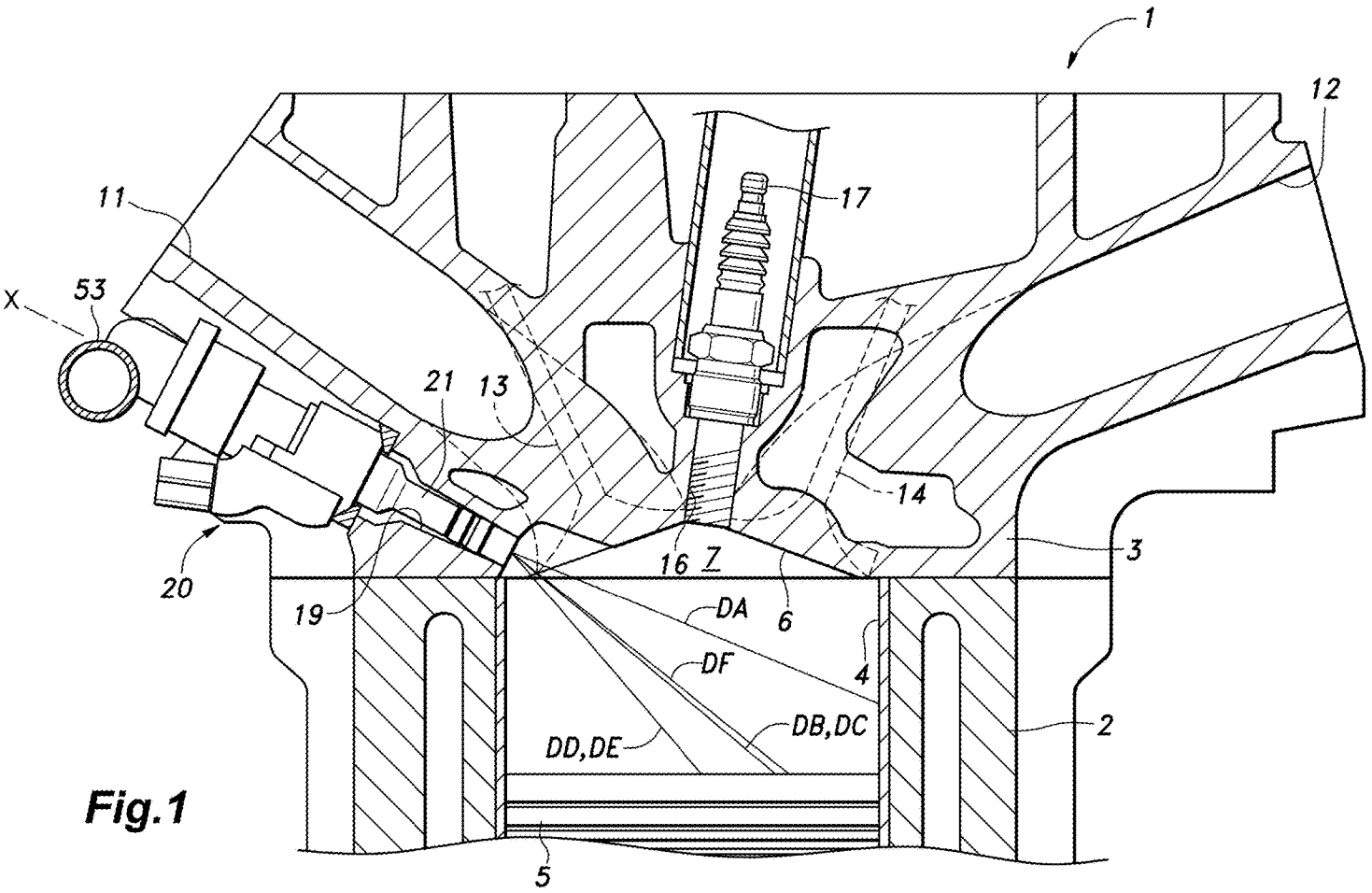
FIG. 1 is a sectional view of an internal combustion engine including a fuel injector according to a first embodiment of the present invention.

As shown in FIG. 1, an internal combustion engine 1 of an automobile is provided with a cylinder block 2 and a cylinder head 3 attached to an upper end of the cylinder block 2. A plurality of cylinders 4 are formed in the cylinder block 2, and a piston 5 is slidably received in each cylinder 4 along the axial line of the cylinder 4. A plurality of combustion chamber recesses 6 substantially in a rooftop shape are formed in parts of the cylinder head 3 facing the respective cylinders 4. Each combustion chamber recess 6 defines a combustion chamber 7 in cooperation with the upper surface of the corresponding piston 5.

A pair of intake ports 11 are formed on one side of each combustion chamber recess 6. Each intake port 11 extends from the combustion chamber recess 6 to a side wall of the cylinder head 3 and opens out to the outside. A pair of exhaust ports 12 are formed on the other side of the combustion chamber recess 6. Each exhaust port 12 extends from the combustion chamber recess 6 to the other side wall of the cylinder head 3 and opens out to the outside. The end of each intake port 11 on the side of the combustion chamber 7 is provided with an intake valve 13 consisting of a poppet valve for selectively closing the intake port 11. The end of each exhaust port 12 on the side of the combustion chamber 7 is provided with an exhaust valve 14 consisting of a poppet valve for selectively closing the exhaust port 12. A spark plug mounting hole 16 is centrally passed into a part of the cylinder head 3 in a vertical direction, and a spark plug 17 is threaded into the spark plug mounting hole 16.

A fuel injector hole 19 is passed into a part of the cylinder head 3 located on the intake side of the cylinder head 3. The fuel injector hole 19 has a central axial line X which is at an angle relative to the central axial line of the cylinder 4. The inner end of the fuel injector hole 19 is positioned between the two intake ports 11, and the outer end of the fuel injector hole 19 opens out at the corresponding side wall of the cylinder head 3 at a position below the intake ports 11 and above the cylinder block 2.

A fuel injector 20 is inserted in the fuel injector hole 19. The fuel injector 20 extends along the axial line X. A tip end of the fuel injector 20 is exposed to the combustion chamber 7, while a base end of the fuel injector 20 projects out of the cylinder head 3.

Figure 2:
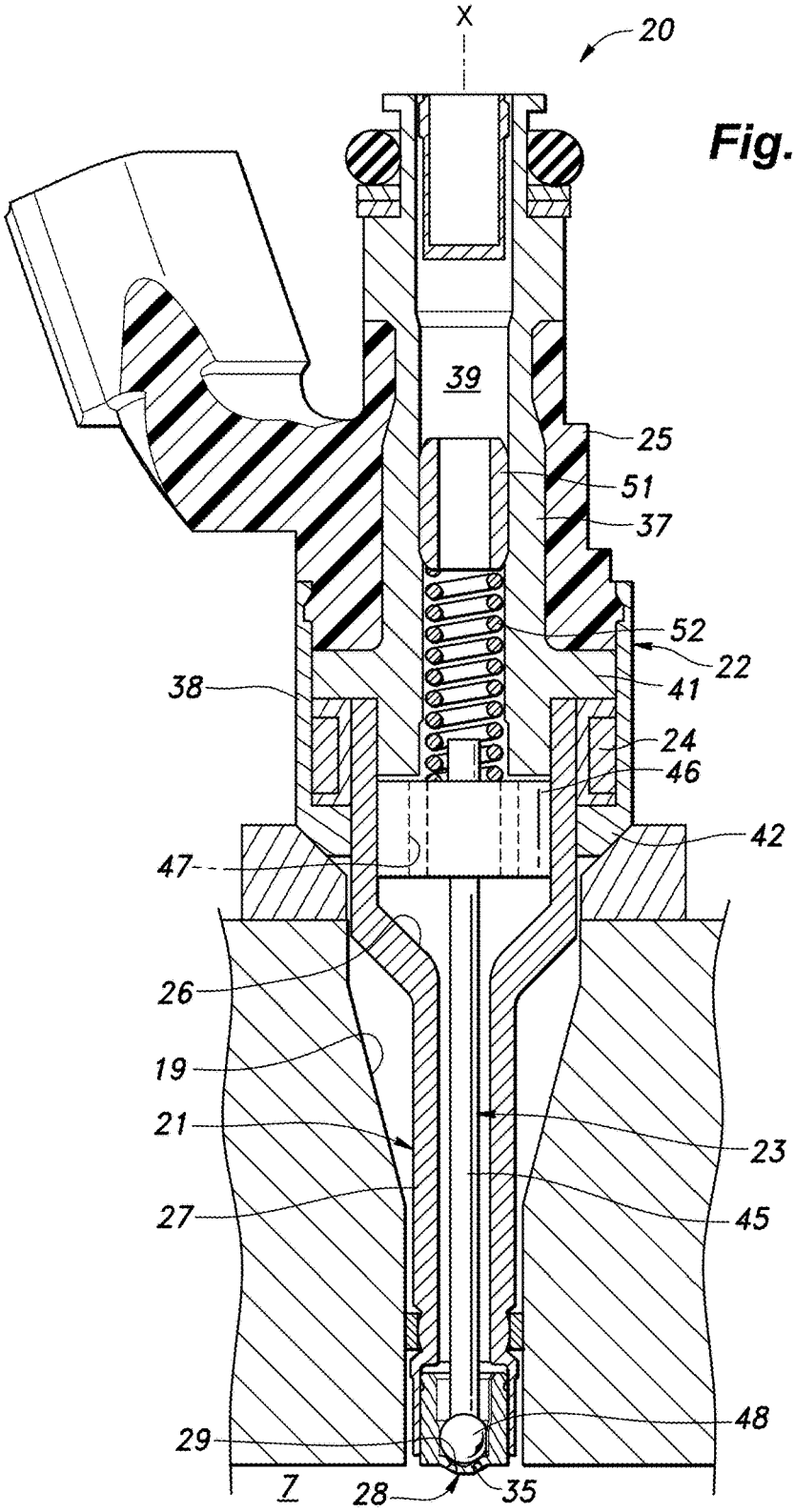
FIG. 2 is a sectional view of the fuel injector.

As shown in FIG. 2, the fuel injector 20 includes a nozzle 21 provided at the tip end thereof, a housing 22 provided in the base end, a valve member 23 slidably received in the nozzle 21, and a solenoid 24 accommodated in the housing 22. A cover member 25 made of plastic material is insert molded on the outer periphery of the housing 22.

The nozzle 21 includes a cylindrical nozzle main body 27 extending along the axial line X (nozzle axial line X) and internally defining a first flow passage 26 for conducting fuel. The nozzle axial line X is arranged coaxially with the axial line of the fuel injector 20. The base end part of the nozzle main body 27 is enlarged in diameter with respect to the tip end part thereof. The tip end part of the nozzle main body 27 is closed by a nozzle tip portion 28. In the present embodiment, the nozzle tip portion 28 is a separate member assembled to the nozzle main body 27, but in other embodiments the nozzle tip portion 28 may be a member integral with the nozzle main body 27.

Figure 3:
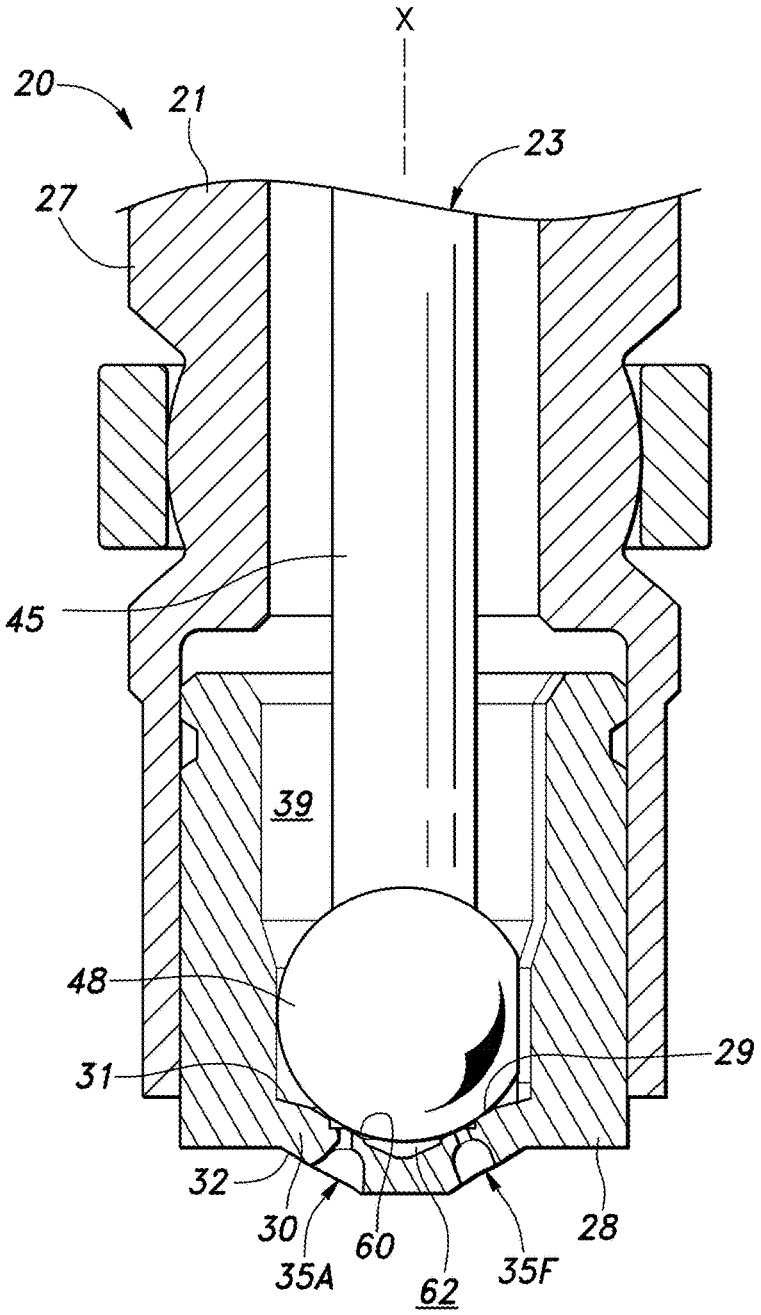
FIG. 3 is an enlarged sectional view of a tip portion of the fuel injector.

As shown in FIG. 3, the nozzle tip portion 28 is provided with a bottom wall 30 defining an inner surface 31 facing the base end side (the first flow passage 26 side) of the nozzle 21, and an outer surface 32 facing away from the base end side. As will be described later, the nozzle tip portion 28 is provided with an annular valve seat 29 formed on the inner surface 31 of the bottom wall 30, and a plurality of injection holes 35 penetrating the bottom wall 30. In the present embodiment 100, the injection holes 35 include a first to a sixth injection hole 35A to 35F (see FIGS. 4 and 5). In the following description, the suffixes A to F are appended to the reference numerals to individually denote the first to sixth injection holes 35A to 35F, and the suffixes A to F are abbreviated when the injection holes 35 are collectively referred to.

As shown in FIG. 2, the housing 22 is formed by combining a first housing part 37 and a second housing part 38. The first housing part 37 is formed in a cylindrical shape with two open ends, and internally defines a second flow passage 39 for conducting fuel. One end of the first housing part 37 is inserted into the opening of the base end of the nozzle main body 27 so that the first flow passage 26 and the second flow passage 39 are connected to each other. The first housing part 37 is provided with a first radial flange 41 projecting radially outward at a predetermined distance from the one end thereof. The relative axial position between the nozzle main body 27 and the first housing part 37 is determined by the first flange 41 abutting against the end face of the base end of the nozzle main body 27. The first flange 41 protrudes outward from the outer peripheral surface of the base end part of the nozzle main body 27.

The second housing part 38 is formed in a tubular shape with two open ends, and is provided with a radial second flange 42 projecting radially inward at the tip end part thereof. The second housing part 38 is fitted on the outer periphery of a base end part of the nozzle main body 27 and the first housing part 37 in such a manner that the inner circumferential surface of the second housing part 38 is in contact with the outer circumferential surface of the first radial flange 41, and the inner circumferential surface of the second radial flange 42 is in contact with the outer circumferential surface of the base end part of the nozzle main body 27. An annular space centered around the nozzle axial line X is defined by the base end part of the nozzle main body 27, the second housing part 38, the first radial flange 41, and the second radial flange 42, and the annular solenoid 24 is received therein. The solenoid 24 is connected to terminals in a connector formed by a cover member 25 via wires. The solenoid 24 is connected to a control circuit via the terminals so as to receive controlled electric power from a power source.

The valve member 23 includes a columnar shaft 45 extending along the nozzle axial line X in the first flow passage 26 and a circular disk 46 formed at the base end of the shaft 45 in a coaxial relationship. The disk 46 has a predetermined thickness and has an outer peripheral surface in sliding contact with the inner circumferential surface of the base end part of the nozzle main body 27. A plurality of passage holes 47 are passed through the disk 46 in the axial direction. The valve member 23 is displaceable in the axial direction with respect to the nozzle main body 27. A tip end 48 of the shaft 45 is formed into a spherical shape that is configured to be seated on the valve seat 29.

A cylindrical spring seat 51 having two open ends is press fitted into the second flow passage 39 of the first housing part 37. A spring 52 consisting of a compression coil spring is interposed between the spring seat 51 and the disk 46. The spring 52 urges the valve member 23 toward the tip side of the nozzle 21, or in the direction to seat the valve member 23 on the valve seat 29.

The base end part of the first housing part 37 is connected to a fuel pipe 53 so that the fuel pressurized by a fuel pump (not shown in the drawings) is supplied to the first and second flow passages 26 and 39 via the fuel pipe. When the valve member 23 is seated on the valve seat 29, fuel is not supplied to the injection holes 35, and hence is not ejected from the injection holes 35. When electric power is supplied to the solenoid 24, the tip end part of the first housing part 37 is magnetized by the solenoid 24, causing the disk 46 to be attracted to the tip end part of the first housing part 37, and the valve member 23 is lifted from the valve seat 29. As a result, fuel is supplied to the injection holes 35, and fuel is ejected from each injection hole 35.

Figure 4:
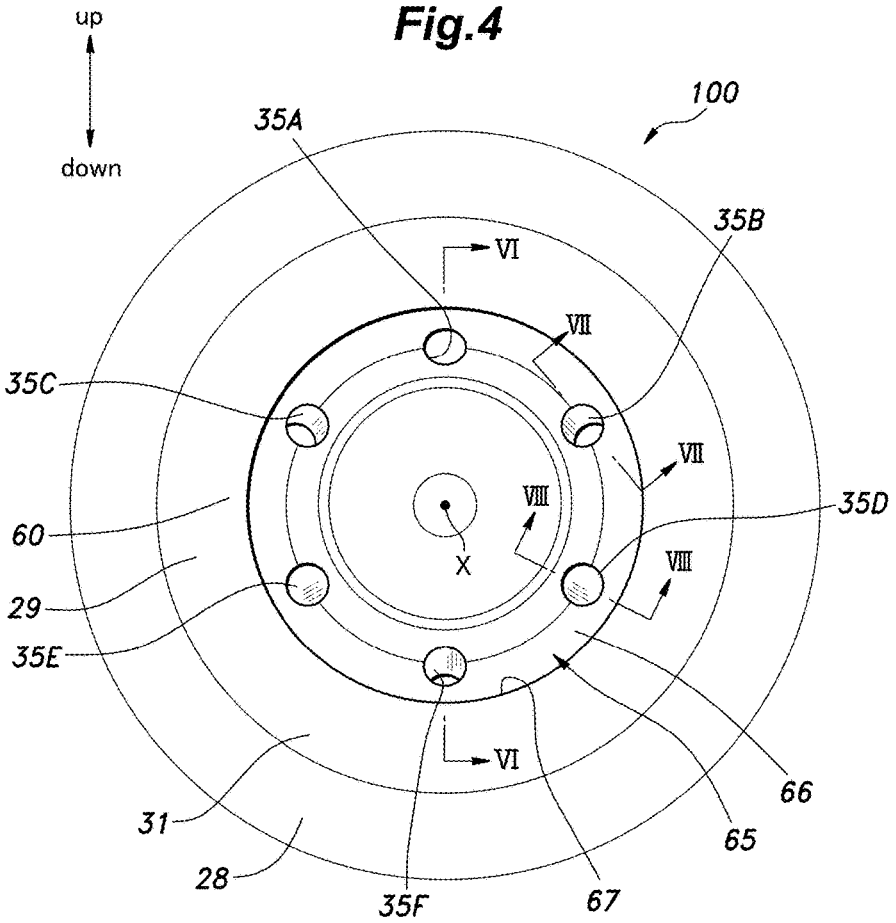
FIG. 4 is a plan view of the nozzle tip portion as viewed from the interior thereof.
Figure 6:
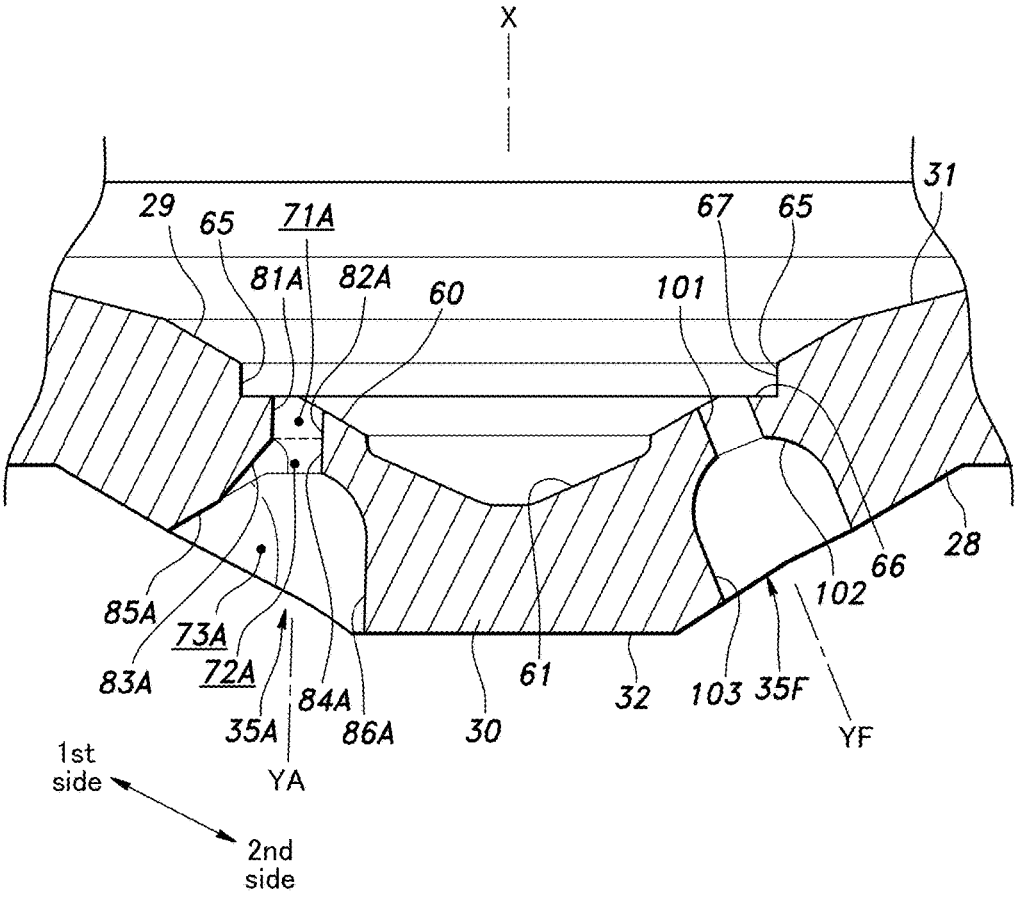
FIG. 6 is a sectional view of a first and a sixth injection hole taken along line VI-VI of FIG. 2.

Parts associated with the nozzle tip portion 28 are described in the following in some detail. As shown in FIGS. 3, 4 and 6, a tapered surface 60 recessed toward the tip side and centered around the nozzle axial line X is formed on the inner surface 31 of the bottom wall 30 of the nozzle tip portion 28. A central part 61 of the tapered surface 60 of the inner surface 31 is further recessed toward the tip end side than the remaining part of the inner surface 31. The outer surface 32 of the bottom wall 30 of the nozzle tip portion 28 is formed as a convex surface corresponding to the concave inner surface 31, except for that the central part of the outer surface (lower surface) 32 is formed as a flat surface orthogonal to the nozzle axial line X.

The tapered surface 60 of the bottom wall 30 of the nozzle tip portion 28 is concentrically provided with the annular valve seat 29, and the shaft 45 is provided with the tip end 48 which is spherical, semispherical or conical in shape so that the tip end 48 can closely contact the valve seat 29 at an annular contact surface centered around the nozzle axial line X as discussed earlier. When the tip end 48 of the shaft 45 is seated on the valve seat 29, a gap 62 is created between the outer surface of the tip end 48 of the shaft 45 and a central part 61 of the inner surface 31 of the bottom wall 30 of the nozzle tip portion 28, and the gap 62 is separated from the first flow passage 26 by the valve member 23.

The inner ends of the injection holes 35 are surrounded by the valve seat 29, and positioned along a circle centered around the nozzle axial line X at a regular interval. In FIG. 4 which is a plan view of the bottom wall 30 of the nozzle tip portion 28, the first injection hole 35A is illustrated as being at the upper end, and the sixth injection hole 35F is positioned at the lower end. The following discussion will be based on this definition of the positioning for the convenience of description although in reality the nozzle axial line X is oriented vertically.

The second and third injection holes 35B and 35C are positioned on either side of the first injection hole 35A, and the fourth and fifth injection holes 35D and 35E are positioned on either side of the sixth injection hole 35F. The first injection hole 35A, the second injection hole 35B, the fourth injection hole 35D, the sixth injection hole 35F, the fifth injection hole 35E and the third injection hole 35C are arranged along the circle in that order in clockwise direction, as seen in FIG. 4.

Figure 5:
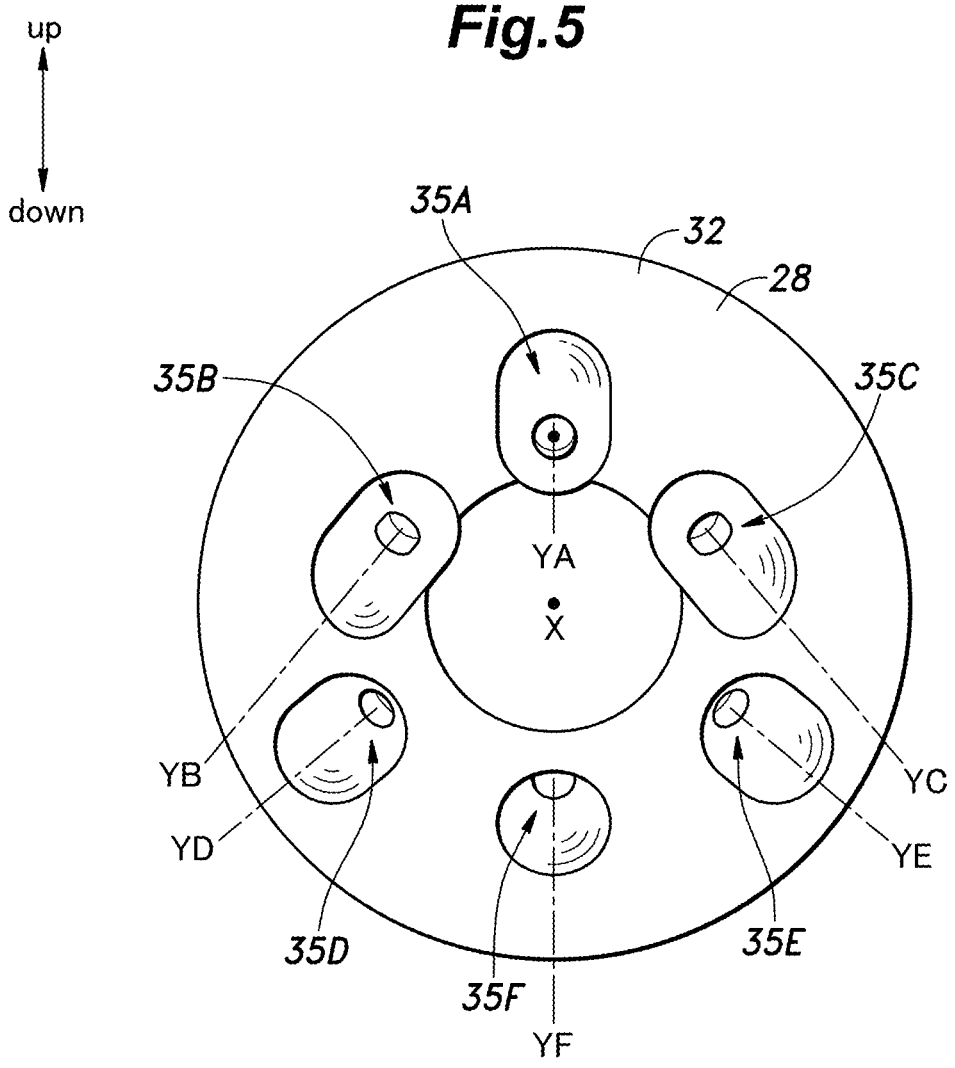
FIG. 5 is a bottom view of the nozzle tip portion as viewed from the exterior thereof.

As shown in FIG. 5, the axial lines Y of the injection holes 35 extend in mutually different directions. In the state where the fuel injector 20 is installed in the internal combustion engine 1, the axial line YA of the first injection hole 35A and the axial line YF of the sixth injection hole 35F are disposed on a common reference plane defined by the nozzle axial line X and the cylinder axial line.

The axial line YA of the first injection hole 35A is disposed substantially parallel to the nozzle axial line X. The axial line YF of the sixth injection hole 35F is inclined downward toward the tip side with respect to the nozzle axial line X on the reference plane. The axial line YB of the second injection hole 35B and the axial line YC of the third injection hole 35C are arranged so as to be symmetric with respect to the reference plane. The axial line YB of the second injection hole 35B and the axial line YC of the third injection hole 35C are inclined downward and laterally away from the reference plane toward the tip side. The axial line YD of the fourth injection hole 35D and the axial line YE of the fifth injection hole 35E are arranged so as to be symmetric with respect to the reference plane. The axial line YD of the fourth injection hole 35D and the axial line YE of the fifth injection hole 35E are inclined downward and laterally away from the reference plane toward the tip side. The axial line YD of the fourth injection hole 35D is more sharply inclined both in the lateral and downward directions than the axial line YB of the second injection hole 35B, and the axial line YE of the fifth injection hole 35E is more sharply inclined both in the lateral and downward directions than the axial line YC of the third injection hole 35C. The downward inclination angle of the axial line YF of the sixth injection hole 35F with respect to the nozzle axial line X is smaller than that of the axial line YB of the second injection hole 35B and the axial line YC of the third injection hole 35C.

As shown in FIG. 1, the fuel injection directions DA to DF of the first to sixth injection holes 35A to 35F have a downward spread as viewed from a direction orthogonal to the reference plane defined by the cylinder axial line and the nozzle axial line X. The fuel injection direction DA of the first injection hole 35A is substantially parallel to the nozzle axial line X while the fuel injection direction DF of the sixth injection hole 35F, the fuel injection directions DB and DC of the second and third injection holes 35B and 35C, and the fuel injection directions DD and DE of the fourth and fifth injection holes 35D and 35E are directed progressively more downward in that order.

As shown in FIGS. 4 and 6, an annular recess 65 is formed in the tapered surface 60 of the bottom wall 30 in a concentric manner relative to the nozzle axial line X. The recess 65 is defined by a planar bottom surface 66 orthogonal to the nozzle axial line X and an outer circumferential surface 67 (cylindrical side surface) substantially orthogonal to the bottom surface 66 and concentric to the nozzle axial line X. The bottom surface 66 overlaps with radially (with respect to the nozzle axial line X) outer parts of the injection holes 35 so that the radially outer part of the upper open end of each injection hole 35 is defined by the planar bottom surface 66 while the radially inner part of the upper open end of the injection hole 35 is defined by the tapered surface 60 of the bottom wall 30 of the nozzle tip portion 28. The width of the recess 65 (the radial dimension of the bottom surface 66 with respect to the nozzle axial line X) is preferably 80% to 150% of the radius of the inner ends of the injection holes 35, and the depth of the recess 65 (the height of the outer circumferential surface 67) is preferably 80% to 150% of the radius of the inner ends of the injection holes 35.

Figure 7:
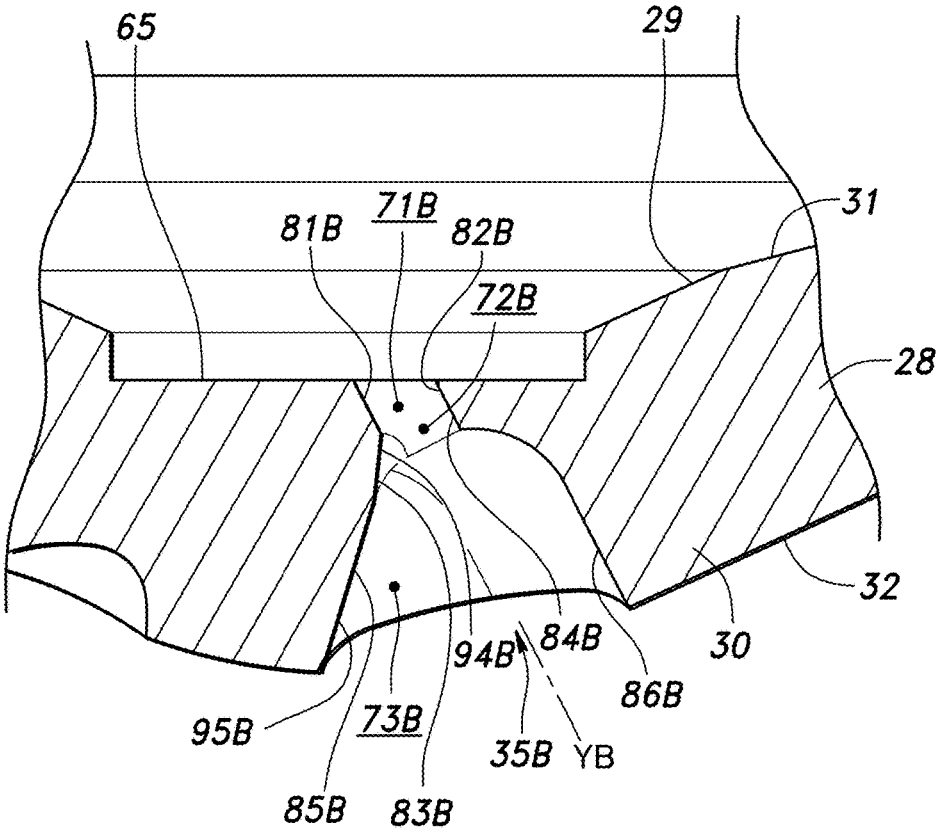
FIG. 7 is a sectional view of a second injection hole taken along line VII-VII of FIG. 4.
Figure 8:
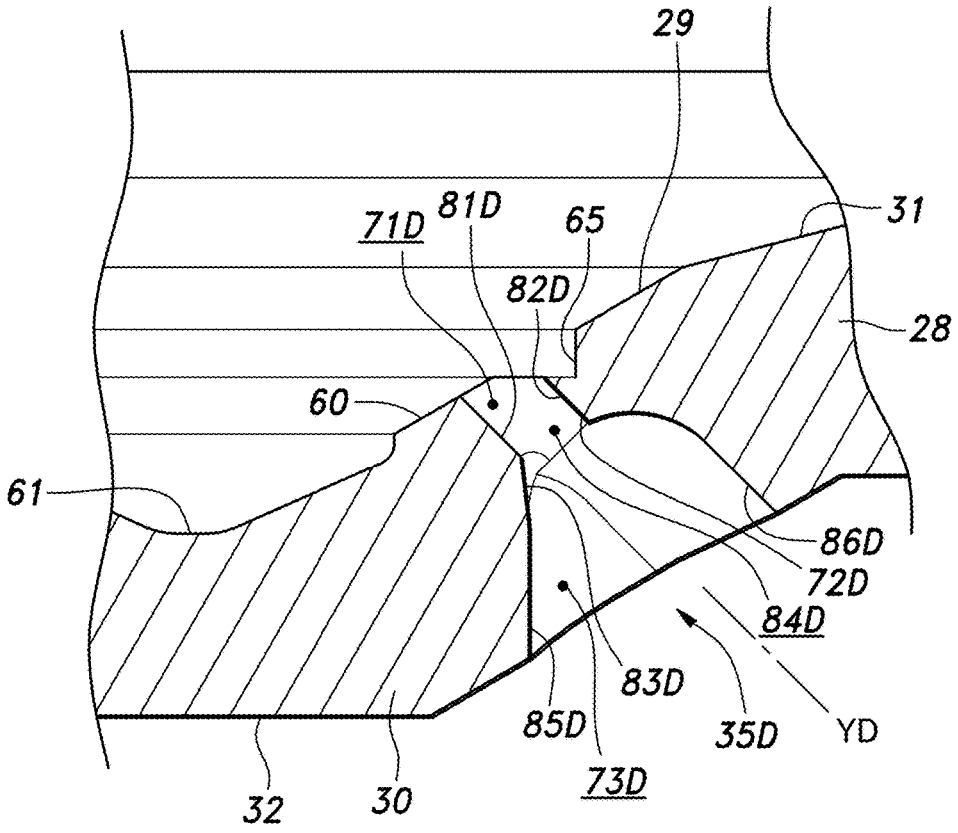
FIG. 8 is a sectional view of a fourth injection hole taken along line VIII-VIII of FIG. 4.

FIG. 6 is a sectional view of the nozzle tip portion 28 containing the axial line YA of the first injection hole 35A and the axial line YF of the sixth injection hole 35F. FIG. 7 is a sectional view of the nozzle tip portion 28 containing the axial line YB of the second injection hole 35B. FIG. 8 is a sectional view of the nozzle tip portion 28 containing the axial line YD of the fourth injection hole 35D. It is to be noted that the third injection hole 35C has a structure symmetric to that of the second injection hole 35B, and the fifth injection hole 35E has a structure symmetric to that of the fourth injection hole 35D. As shown in FIGS. 6 to 8, each of the first to fifth injection holes 35A to 35E includes an inner hole section 71, a middle hole section 72, and an outer hole section 73 in that order from the base end side. The inner hole section 71 consists of a linearly extending hole having a constant circular cross section. The axial lines YA to YE of the first to fifth injection holes 35A to 35E coincide with the axial lines of the respective first to fifth inner hole sections 71A to 71E.

The inner hole sections 71A to 71E of the first to fifth injection holes 35A to 35E are straight circular holes (true cylinder holes) extending from the tapered surface 60 obliquely away from a side with respect to the normal line of the tapered surface 60. The side away from which each inner hole section 71 extends obliquely is defined as a first side, and the side diametrically opposite to the first side or to which each inner hole section 71 extends obliquely relative to the normal line of the tapered surface 60 is defined as a second side for the convenience of the following disclosure.

Thus, the inner hole section 71 is provided with a side wall surface on the first side (a first inner side wall surface 81) that forms an obtuse angle with the adjoining part of the tapered surface 60, and a side wall surface on the second side (a second inner side wall surface 82) that forms an acute angle with the adjoining part of the tapered surface 60.

The middle hole section 72 is provided with a side wall surface on the first side (a first middle side wall surface 83) that is a continuation of the first inner side wall surface 81 and is slanted toward the first side relative to the first inner side wall surface 81, and a side wall surface on the second side (second middle side wall surface 84) that is a continuation of the second inner side wall surface 82 without any change in the slant angle.

The outer hole section 73 is provided with a side wall surface on the first side (a first outer side wall surface 85) that is a continuation of the first middle side wall surface 83 and is more sharply slanted toward the first side than the first middle side wall surface 83, and a side wall surface on the second side (a second outer side wall surface 86) that is a continuation of the second middle side wall surface 84 and slants sharply toward the second side (in an immediate vicinity of the second middle side wall surface 84) before extending substantially in parallel with the second middle side wall surface 84.

Thus, the first inner side wall surface 81 forms an obtuse angle to the adjoining tapered surface 60, the first middle side wall surface 83 slants toward the first side relative to the first inner side wall surface 81, and the first outer side wall surface 85 slants toward the first side more sharply. Meanwhile, the second inner side wall surface 82 forms an acute angle to the adjoining tapered surface 60, the second middle side wall surface 84 extends as a linear extension of the second inner side wall surface 82, and the second outer side wall surface 86 flares out (toward the second side) relative to the second inner side wall surface 82.

The first side of the first injection hole 35A coincides with the radially outer side with respect to the nozzle axial line X, and the second side of the first injection hole 35A coincides with the radially inner side with respect to the nozzle axial line X. In regard to each of the second to the fifth injection holes 35B to 35E, the first side is at an angle to the radial line emanating from the nozzle axial line X.

The cross sectional area of the inner hole section 72 is greater than that of the middle hole section 71, and the cross sectional area of the outer hole section 73 is greater than that of the middle hole section 71.

Figure 9:
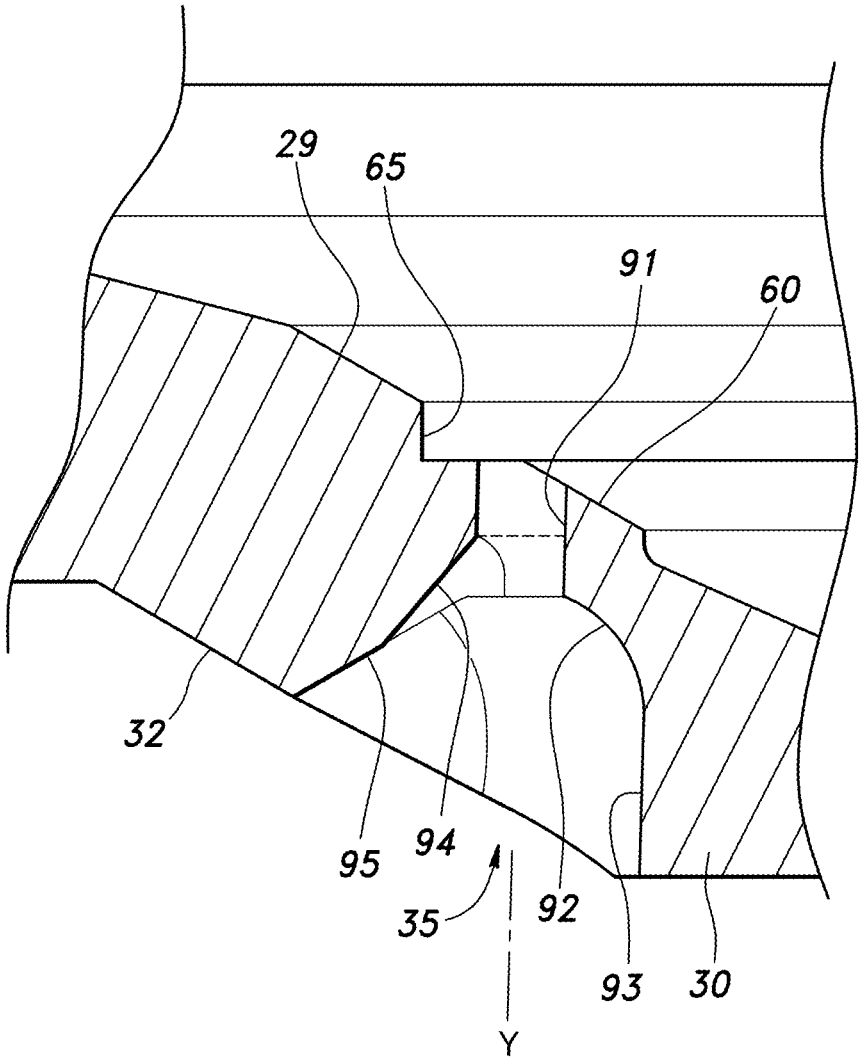
FIG. 9 is a sectional view of one of the injection holes given as a representative example.

The first to fifth injection holes 35A to 35E may be described in a different way as discussed in the following with reference to FIG. 9. In FIG. 9, the left side is defined as a first side, and the right side is defined as a second side. More specifically, each of the first to fifth injection holes 35A to 35E includes a small diameter section 91 consisting of a linear hole having a circular cross section and extends in a direction which is slanted with respect to the normal line of the tapered surface 60 toward the second side, a tapered section 92 coaxially connected to the small diameter section 91 and provided with a progressively increasing diameter, and a large diameter section 93 coaxially connected to the tapered section 92 and consisting of a substantially linear hole having a circular cross section of a greater diameter than the small diameter section 91.

The injection hole 35 further includes a first expanded portion 94 formed so as to enlarge the tapered section 92 toward the first side, and a second expanded portion 95 formed so as to enlarge the large diameter section 93 toward the first side. An upper part of the small diameter section 91 may correspond to the inner hole section 71. The remaining lower part of the small diameter section 91 and most part of the tapered section 92 (including the first expanded portion 94) may correspond to the middle hole section 72. The remaining part of the tapered section 92 and the large diameter section 93 (including the second expanded portion 95) may correspond to the outer hole section 73. The lateral width of the first expanded portion 94 may be substantially equal to the diameter of the small diameter section 91, and the lateral width of the second expanded portion 95 may be equal to the diameter of the large diameter section 93.

The wall surface of the first expanded portion 94 is slanted to the first side (toward the tip end side) than the corresponding wall surface of the small diameter section 91, and the wall surface of the second expanded portion 95 is more slanted to the first side (toward the tip end side) than the wall surface of the first expanded portion 94.

The base end side end of the first expanded portion 94 may be located in an axially middle point of the side wall surface of the small diameter section 91 on the first side.

As shown in FIG. 6, the sixth injection hole 35F includes a small diameter section 101 consisting of a linear hole having a circular cross section and slightly slanting to the first side with respect to the normal line of the tapered surface 60, a tapered section 102 connected coaxially to the small diameter section 101 and having a progressively increasing diameter toward the tip end side, and a large diameter section 103 consisting of a linear hole having a circular cross section of a greater diameter than the small diameter section 101.

The mode of operation and advantages of the injector 20 of the first embodiment are discussed in the following. In particular, the first injection hole 35 is compared with an injection hole 200 of a first example for comparison shown in FIG. 10*a* and an injection hole 300 of a second example for comparison shown in FIG. 10*b*. The injection hole 200 of the first example shown in FIG. 10*a* includes a small diameter section 201 consisting of a linear hole having a circular cross section and slanting toward the second side with respect to a normal line of the tapered surface 60, a tapered section 202 coaxially and continuously connected to the small diameter section 201 and having a progressively increasing diameter toward the tip end side, and a large diameter section 203 coaxially and smoothly connected to the tapered section 202 and consisting of a linear hole having a circular cross section. The injection hole 300 of the second example shown in FIG. 10*b* includes a small diameter section 301, a tapered section 302 and a large diameter section 303 similar to those of the injection hole 200 of the first example, and is further provided with a recess 304 on a first side of the inner end of the small diameter section 301. The recess 304 is of a similar configuration as the recess 65 of the first embodiment. The first example and the second example are similar to the first embodiment except for the configuration of the injection holes.

When the valve member 23 is lifted from the valve seat 29, the flow of fuel from a radially outward part of the valve seat 29 toward the injections holes 35, 200, 300 is dominant over the flow of fuel from a central part of the valve seat 29 toward the fuel injection holes 35, 200, 300.

Figure 10A:
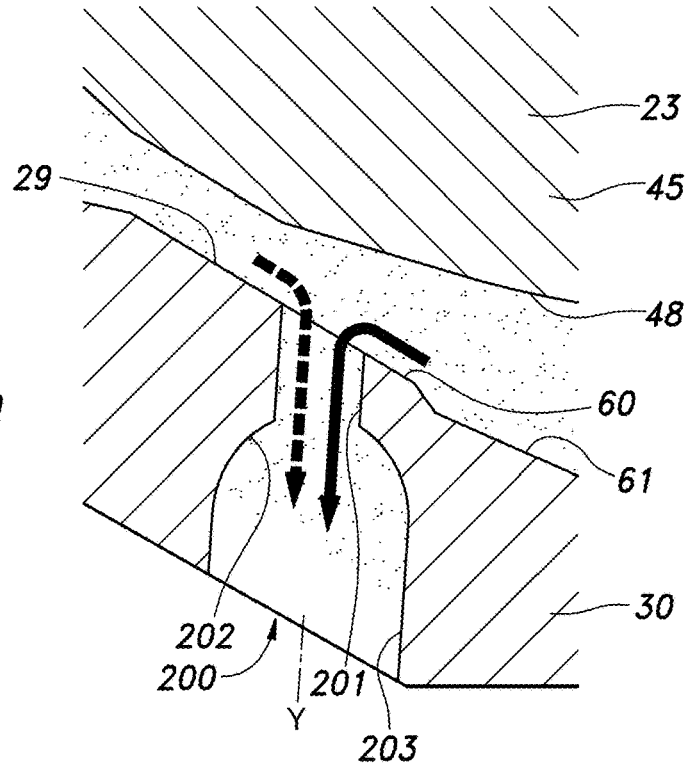
FIGS. 10*a* and 10*b* are sectional views showing two examples of injection holes for comparison with the first embodiment of the present invention.

As shown in FIG. 10*a*, in the case of the injection hole 200, the side wall surface on the first side forms an obtuse angle to the tapered surface 60 while the side wall surface on the second side forms an acute angle to the tapered surface 60. However, parts of the fuel flowing from the two sides (indicated by a dotted arrow and a solid arrow) push against each other so that flow separation does not occur in the small diameter section 201, in particular in spite of the acute angle formed between the side wall surface on the second side and the tapered surface 60.

Figure 10B:
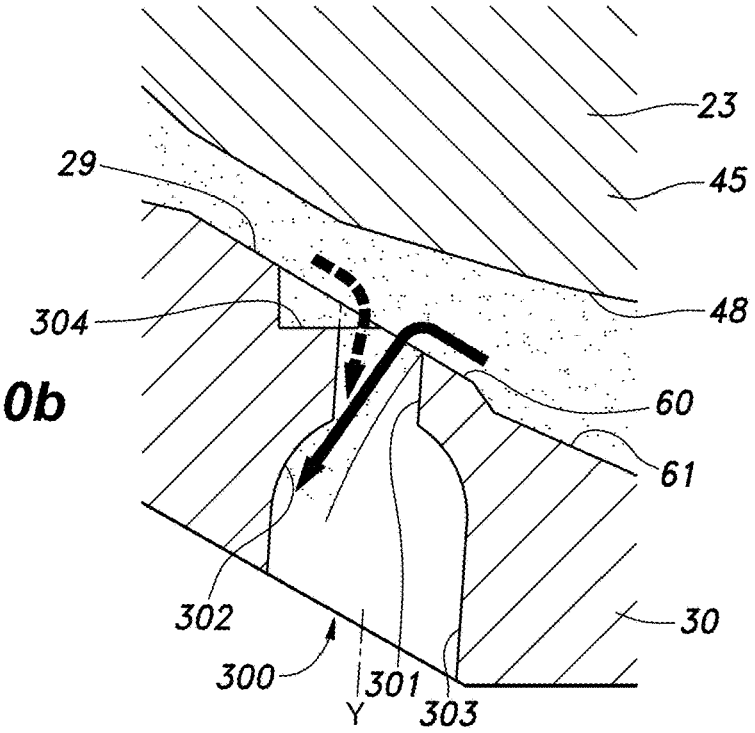

As shown in FIG. 10*b*, in the case of the injection hole 300, owing to the presence of the recess 304, the velocity of the fuel flow on the first side (indicated by a dotted arrow) of the small diameter section 301 is reduced as compared to the fuel flow on the second side of the small diameter section 301. As a result, the fuel flow on the second side (indicated by a solid arrow) of the small diameter section 301 is less interfered by the fuel flow on the first side with the result that flow separation is likely to occur in the small diameter section 301 to the fuel flow along the side wall surface of the small diameter section 301 on the second side owing to the acute angle formed between the side wall surface on the second side and the tapered surface 60. As a result, cavitation is induced in the fuel flow so that the atomization of the fuel is promoted. However, the fuel flow is pushed against the side wall of the large diameter section 303 on the first side so that the narrowing of the fluid flow is likely to occur. As a result, the spreading of the fuel flow is prevented, and this in turn causes an increased penetration of the fuel flow.

Figure 11:
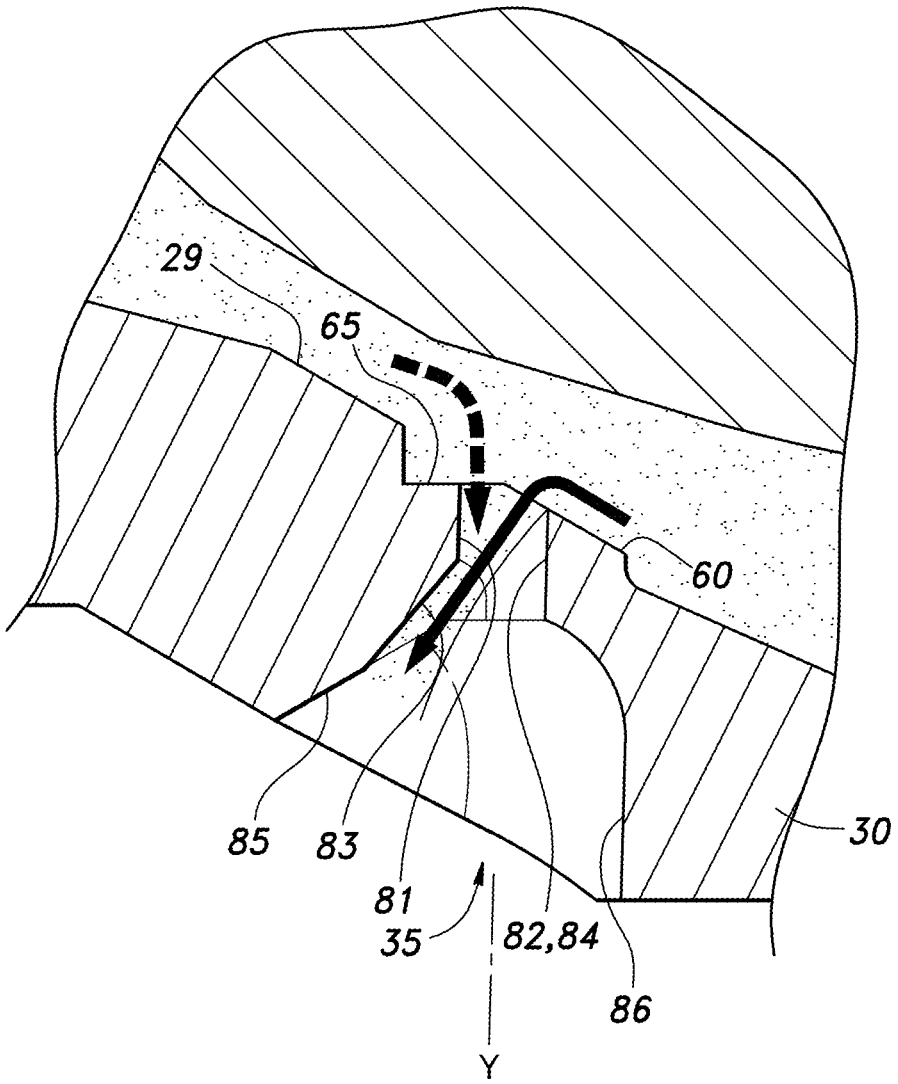
FIG. 11 is a schematic view showing the flow of fuel in the injection hole according to the first embodiment of the present invention.

On the other hand, in the case of the injection hole 35 of the first embodiment shown in FIG. 11, the velocity of the fuel flow entering the inner end of the injection hole 35 from the first side is reduced owing to the presence of the recess 65, similarly as in the case of the second example. In particular, because the recess 65 extends along the entire periphery of the valve seat 29, the flow of fuel from a radially outward part of the valve seat 29 toward the injections holes 35 is less dominant over the flow of fuel from a central part of the valve seat 29 toward the fuel injection holes 35. Therefore, the fuel flow along the side wall surface on the second side that has turned around the corner (between the side wall surface and the tapered surface) is not pushed by the fuel flow entering the injection hole 35 from the first side so that flow separation is likely to occur in a part immediately downstream of the corner. This induces cavitation of the fuel, and this in turn promotes the atomization of the fuel.

The flow separation causes the fuel flow to be concentrated along the first side. However, as the side wall surface of the middle hole section on the first side is slanted toward the first side, and the side wall surface of the outer hole section on the first side is slanted even further in the same direction, the fuel flow in the middle hole section and the outer hole section is prevented from being converged into a narrow fuel flow (or is allowed to spread freely). Also, the progressive increase in the slant angles of the side wall surfaces of the middle hole section and the outer hole section to the first side promotes flow separation and hence the atomization of the fuel. Thus, according to the first embodiment of the present invention, favorable atomization of the fuel and reduction in penetration can be achieved at the same time.

The recess 65 promotes the flow separation at the corner of an acute angle defined between the side wall surface of the inner hole section on the second side and the tapered surface 60 by reducing the fuel flow velocity along the side wall surface of the inner hole section on the first side. The size and the configuration of the recess 65 may be selected in such a manner that the velocity of the fuel flow along the first inner side wall surface is greater than that of the fuel flow along the second inner side wall.

Figure 12:
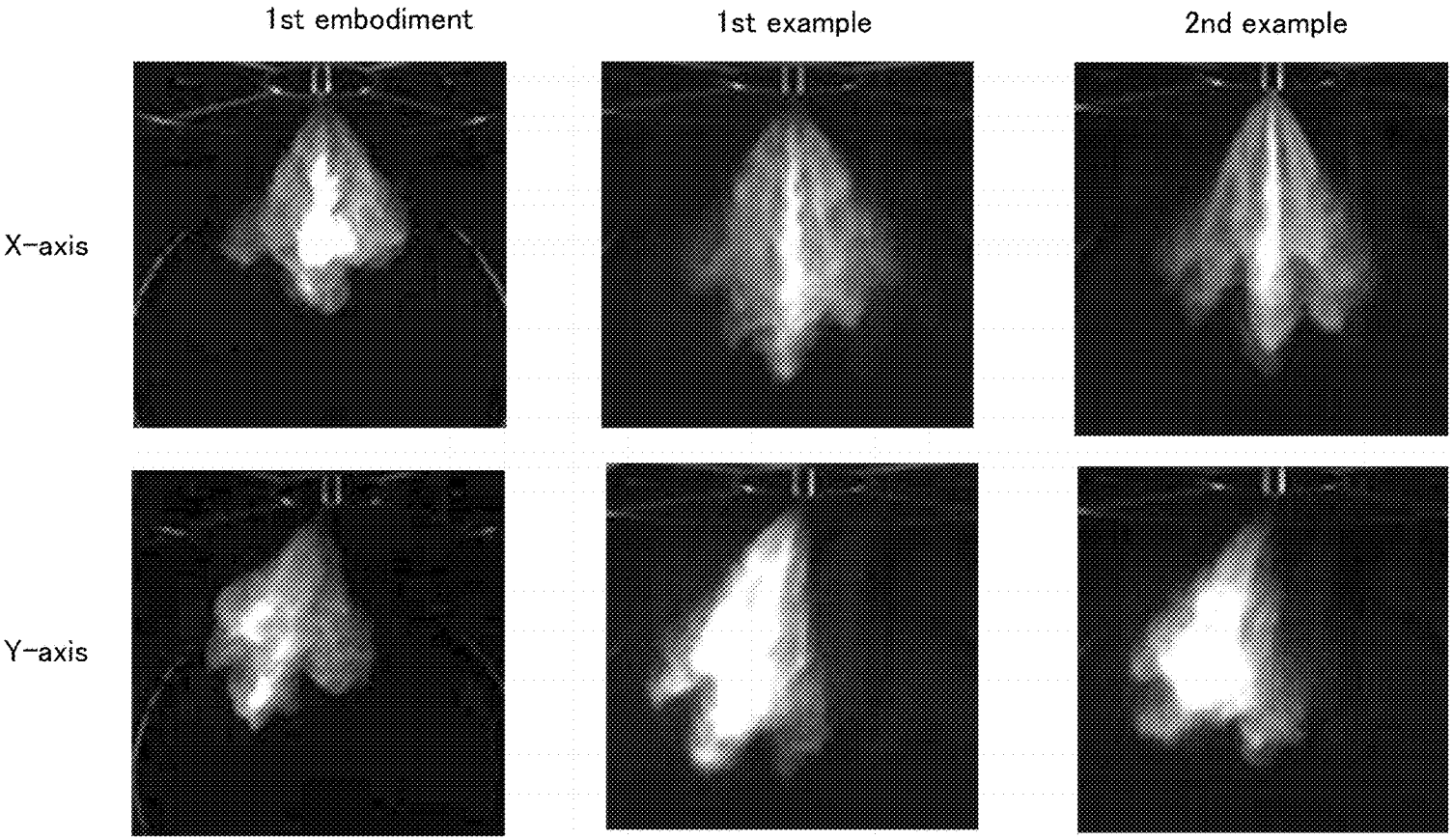
FIG. 12 shows photographic images of fuel ejected from injection holes of a fuel injector according to the first embodiment of the present invention and the fuel injectors of examples for comparison.

FIG. 12 shows photographic images of fuel ejected from the injection holes according to the first embodiment of the present invention, the first example and the second example. In each of these instances, the image was taken after 2 ms from the time point of fuel injection, and the fuel was injected to the atmospheric environment with a fuel pressure of 15 MPa. The X-axis corresponds to the lateral spread of the injected fuel, and the Y-axis corresponds to the vertical spread of the injected fuel. As can be appreciated from these photographic images, the fuel ejected from the injection hole 35 shows less penetration than the fuel ejected from the injection holes 200 and 300, and in particular the core part of the fuel ejected from the injection hole 35 is less powerful than those ejected from the injection holes 200 and 300. It means that the fuel ejected from the injection hole 35 shows less penetration than the fuel ejected from the injection holes 200 and 300.

Figure 13:
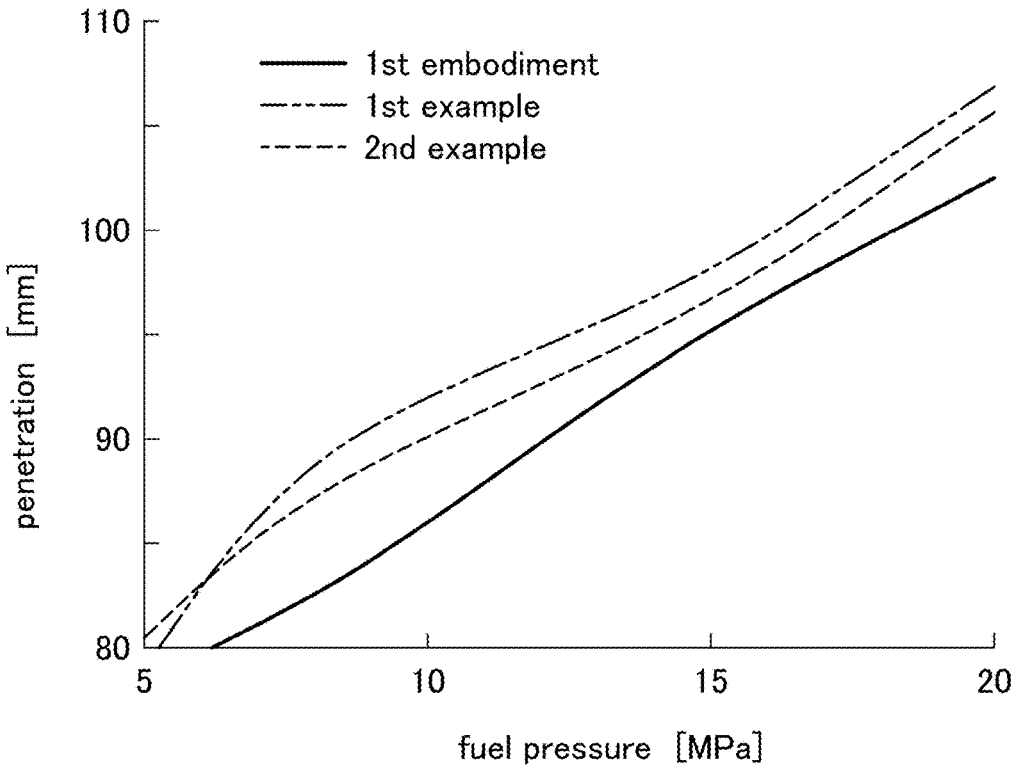
FIG. 13 is a graph showing the relationships between the fuel pressure and the corresponding penetration for the fuel injector of the first embodiment and the fuel injectors of examples for comparison.

FIG. 13 is a graph showing the relationships between the fuel pressure and the corresponding penetration for the fuel injector of the first embodiment and the fuel injectors of the examples for comparison. As can be appreciated from this graph, the fuel ejected from the injection hole 35 shows less penetration than the fuel ejected from the injection holes 200 and 300 over the entire range of fuel pressure.

Figure 14:
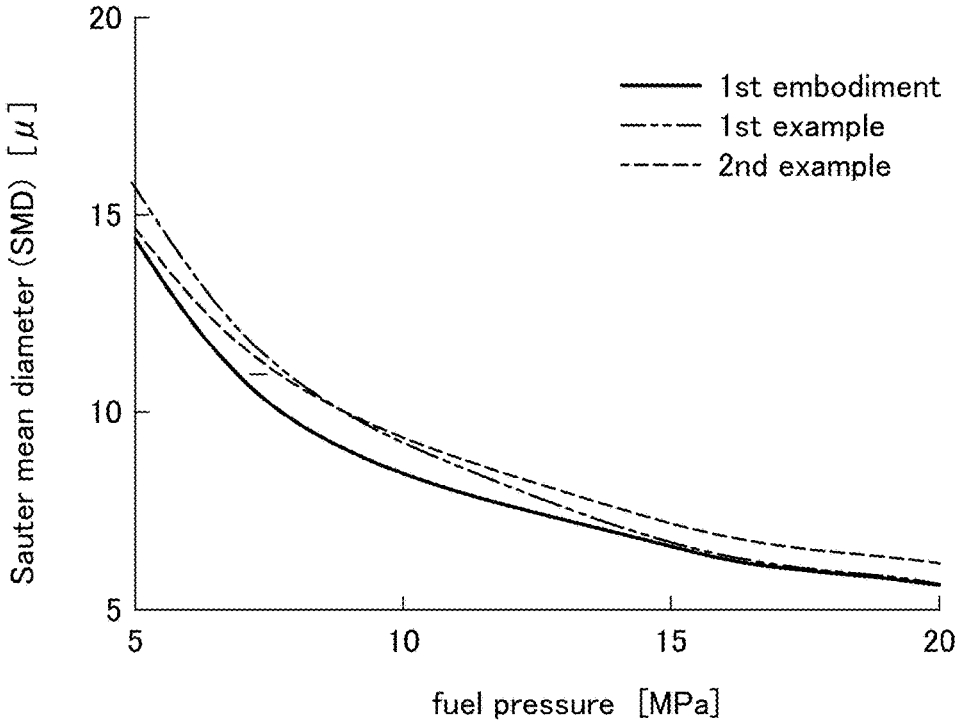
FIG. 14 is a graph showing the relationships between the fuel pressure and the corresponding average particle size for the fuel injector of the first embodiment and the fuel injectors of examples for comparison.

FIG. 14 is a graph showing the relationships between the fuel pressure and the corresponding average particle size for the fuel injector of the first embodiment and the fuel injectors of the examples for comparison. The particle diameter is represented by SMD (Sauter mean diameter). As can be appreciated from this graph, the fuel ejected from the injection hole 35 shows a smaller particle diameter than the fuel ejected from the injection holes 200 and 300 over the entire range of fuel pressure.

Second Embodiment

Figure 15:
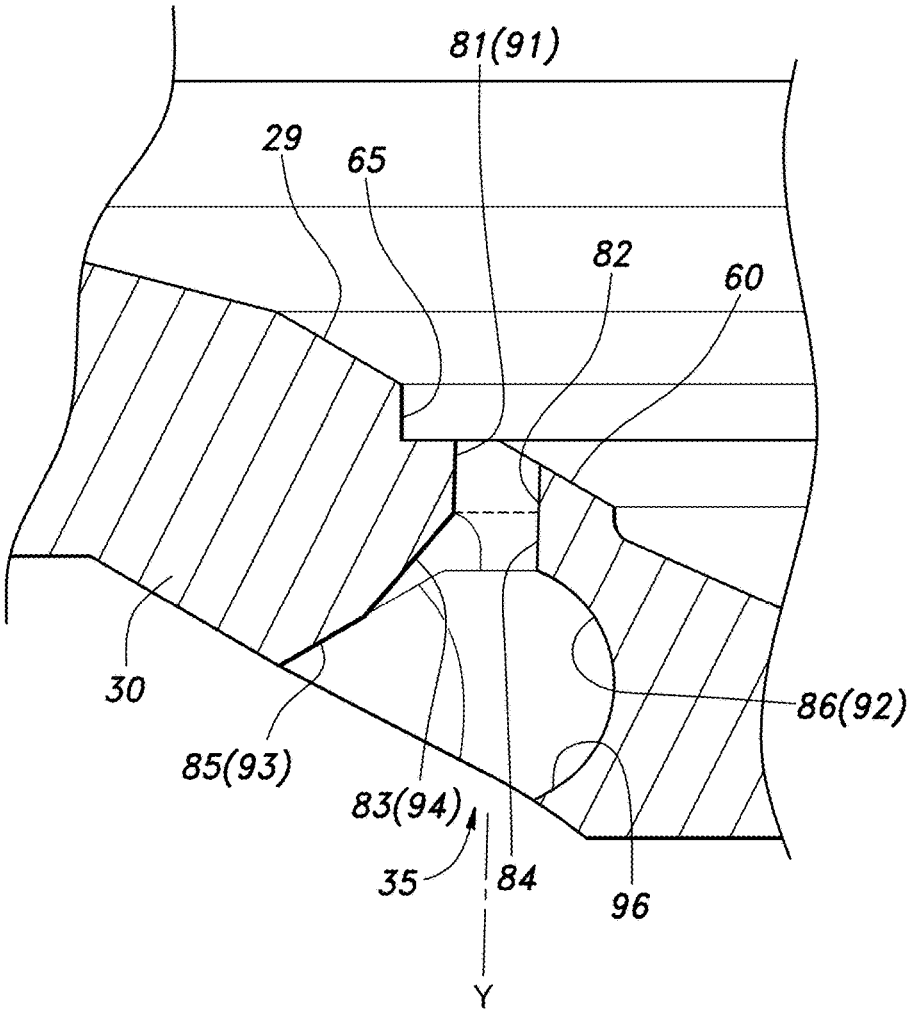
FIG. 15 is a sectional view of an injection hole according to a second embodiment of the present invention.

An injection hole 35 according to a second embodiment of the present invention is described in the following with reference to FIG. 15. This embodiment differs from the first embodiment in that the second outer side wall surface 86 includes a section (outermost section) which extends in parallel with the first outer side wall surface 85. In this case, an outermost part of the outer hole section consists of a linearly extending hole having a constant circular cross section. This embodiment simplifies the machining of the outer hole section.

This injection hole 35 of the second embodiment may be characterized in a different way. The injection hole 35 of the second embodiment may include a small diameter section 91 consisting of a linear hole having a circular cross section and extending in a direction which is slanted with respect to the normal line of the tapered surface 60 toward the second side, a tapered section 92 coaxially connected to the small diameter section 91 and provided with a progressively increasing diameter, and a large diameter section 93 coaxially connected to the tapered section 92 and consisting of a substantially linear hole having a circular cross section of a greater diameter than the small diameter section 91, wherein the large diameter section 93 includes a first narrowed part 96 formed so as to bring the second outer side wall surface 86 toward the first side.

Third Embodiment

Figure 16:
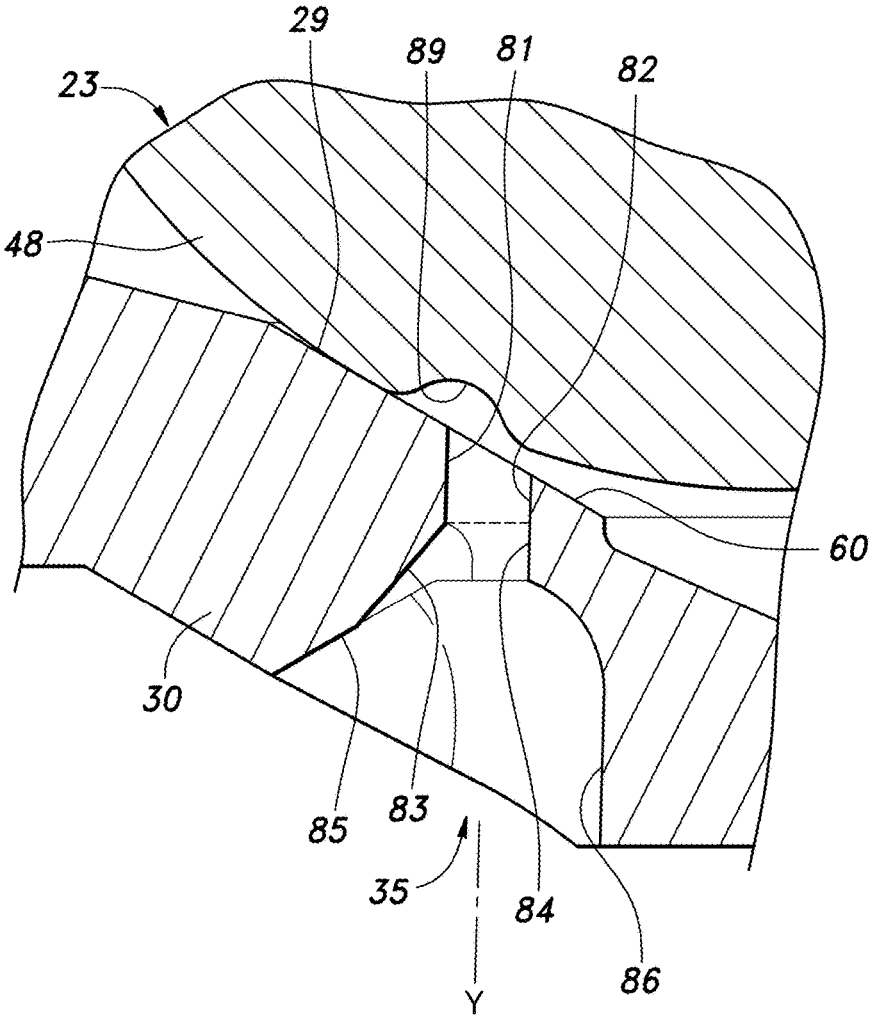
FIG. 16 is an enlarged sectional view of a tip end portion of a fuel injector according to a third embodiment of the present invention.

FIG. 16 is a sectional view of a tip end portion of a fuel injector according to a third embodiment of the present invention. In this embodiment, the recess 65 of the first embodiment is omitted, and a recess 89 is formed in a part of the tip end 48 of the shaft 45 opposing the first side of the inner end of the inner hole section. The recess 89 may be formed in an annular fashion around the central nozzle axial line X. The recess 89 reduces the velocity of the fuel flow flowing from the first side of the inner end of the inner hole section as compared to the velocity of the fuel flow flowing from the second side of the inner end of the inner hole section similarly as the recess 65 of the first embodiment. Alternatively, the recess 65, 89 may be provided discretely and individually on the first side of the inner end of the inner hole section of each injection hole. If desired, both a recess 65 formed in the tapered surface 60 and a recess 89 formed in the tip end 48 of the shaft 45 may be employed at the same time.

Although the present invention has been described in terms of preferred embodiments thereof, it is obvious to a person skilled in the art that various alterations and modifications are possible without departing from the scope of the present invention.

The invention claimed is:

1. A fuel injector, comprising:

a nozzle including a tubular nozzle main body extending along a predetermined central nozzle axial line and internally defining a fuel passage, and a nozzle tip portion including a bottom wall defining an annular valve seat facing the fuel passage in a coaxial relationship to the central nozzle axial line, the nozzle tip portion being provided with a plurality of injection holes passed through the bottom wall and surrounded by the annular valve seat; and a valve member disposed in the fuel passage to be moveable along the central nozzle axial line and configured to be selectively seated on the valve seat;

wherein at least one of the injection holes includes an inner hole section, a middle hole section and an outer hole section in that order from a side of the fuel passage, the inner hole section extending from an inner surface of the bottom wall obliquely away from a first side relative to a normal line of the inner surface of the bottom wall so as to define a first inner side wall surface on the first side forming an obtuse angle relative to the inner surface on the first side and a second inner side wall surface on a second side opposite to the first side forming an acute angle relative to the inner surface on the second side, the middle hole section including a first middle side wall surface connected to the first inner side wall surface so as to extend obliquely relative to the first inner side wall surface toward the first side, and the outer hole section including a first outer side wall surface connected to the first middle side wall surface so as to extend obliquely relative to the first middle side wall surface toward the first side;

wherein a recess is formed on a radially outer side of an inner end of the inner hole section with respect to the central nozzle axial line and/or a part of the valve member opposing the radially outer side of the inner end of the inner hole section with respect to the central nozzle axial line.

2. The fuel injector according to claim 1, wherein the middle hole section includes a second middle side wall surface on the second side continuously extending from the second inner side wall surface in a same direction.

3. The fuel injector according to claim 2, wherein the outer hole section includes a second outer side wall surface on the second side that extends obliquely from the second middle side wall surface toward the second side for a short distance from the second middle side wall surface, and thence extends in parallel with the second middle side wall surface.

4. The fuel injector according to claim 1, wherein the outer hole section includes a second outer side wall surface on the second side extending substantially in parallel with the first outer side wall surface.

5. The fuel injector according to claim 1, wherein the outer hole section includes a second outer side wall surface on the second side extending substantially in parallel with the second inner side wall surface.

6. The fuel injector according to claim 1, wherein the middle hole section has a larger cross sectional area than the inner hole section, and the outer hole section has a larger cross sectional area than the middle hole section.

7. The fuel injector according to claim 1, wherein the inner hole section consists of a linearly extending hole having a constant circular cross section.

8. The fuel injector according to claim 5, wherein the outer hole section has an outermost part consisting of a linearly extending hole having a constant circular cross section.

9. The fuel injector according to claim 1, wherein the injection holes are formed in the bottom wall of the nozzle tip portion along a concentric circle relative to the nozzle axial line, and the recess comprises an annular recess concentrically surrounding the injection holes.

10. The fuel injector according to claim 9, wherein the bottom wall comprises a conical or dome-shaped wall defining a concave inner surface and a convex outer surface, and the recess includes an annular bottom surface orthogonal to the nozzle axial line and a cylindrical side surface extending in parallel with the nozzle axial line.

* * * * *